US009566691B2

(12) United States Patent
Ford

(10) Patent No.: US 9,566,691 B2
(45) Date of Patent: Feb. 14, 2017

(54) GRIPPER TOOL WITH MULTI-FUNCTION ATTACHMENTS

(71) Applicant: Scott K. Ford, Manchester, NH (US)

(72) Inventor: Scott K. Ford, Manchester, NH (US)

( * ) Notice: Subject to any disclaimer, the term of this patent is extended or adjusted under 35 U.S.C. 154(b) by 322 days.

(21) Appl. No.: 14/332,195

(22) Filed: Jul. 15, 2014

(65) Prior Publication Data

US 2015/0020650 A1 Jan. 22, 2015

Related U.S. Application Data

(60) Provisional application No. 61/846,979, filed on Jul. 16, 2013.

(51) Int. Cl.

| | |
|---|---|
| ***B25B 7/04*** | (2006.01) |
| ***B25B 27/14*** | (2006.01) |
| ***B25B 7/14*** | (2006.01) |
| ***B25B 7/12*** | (2006.01) |

(52) U.S. Cl.

CPC ..... *B25B 7/04* (2013.01); *B25B 7/123* (2013.01); *Y10T 29/4984* (2015.01); *Y10T 29/49718* (2015.01)

(58) Field of Classification Search

CPC ..... B25B 7/04; B25B 7/123; B25B 5/04; B25B 5/147; Y10T 29/49718; Y10T 29/4984; B25G 1/10; B25G 3/12; B25G 3/18; B25F 1/02

USPC ..... 81/367

See application file for complete search history.

(56) References Cited

U.S. PATENT DOCUMENTS

| | | | | |
|---|---|---|---|---|
| 2,627,195 | A | 2/1953 | Sporket | |
| 3,446,102 | A * | 5/1969 | Hallmark | B25B 7/02 81/369 |
| 4,247,216 | A * | 1/1981 | Pansini | B25G 3/18 15/1.7 |
| 4,813,310 | A * | 3/1989 | Moynihan | B25G 3/18 269/284 |
| 5,052,251 | A * | 10/1991 | Mills | B25B 7/123 81/324 |
| 5,143,359 | A * | 9/1992 | Bush | B25B 5/163 269/261 |
| 5,301,573 | A | 4/1994 | Weber et al. | |
| 5,526,719 | A * | 6/1996 | Chen | B25D 1/02 30/308.3 |
| 5,542,167 | A | 8/1996 | Nakamoto | |
| 5,884,540 | A * | 3/1999 | Mo | B25B 7/04 81/423 |
| 6,308,597 | B1 * | 10/2001 | Stahle | B23K 37/04 81/302 |

(Continued)

OTHER PUBLICATIONS

International Search Report and Written Opinion mailed Nov. 14 2014 in PCT International Application No. PCT/US2014/046750, Publication No. WO2015009755.

*Primary Examiner* — David B Thomas

(74) *Attorney, Agent, or Firm* — Z IP Law PLLC; Claire Zopf

(57) ABSTRACT

A multi-functional hand tool that has releasable tool attachments that affix to a pair of articulating handles that provide for gripping, rotating, twisting, cutting, pounding, and performing other functions commonly done using a number of different tools. The multi-functional hand tool having a locking mechanism that provides for manipulating a workpiece, without damage or marring of the workpiece.

11 Claims, 13 Drawing Sheets

(56) References Cited

U.S. PATENT DOCUMENTS 6,347,565 B2 2/2002 Steinweg
6,477,925 B2 * 11/2002 Lin ..... B25B 7/04 81/185.1
6,732,617 B2 5/2004 Steinweg et al.
7,373,862 B2 * 5/2008 Tyler ..... B25B 5/12 81/367
7,503,201 B2 3/2009 Cleland et al.
7,861,622 B2 1/2011 Chervanek et al.
7,886,570 B2 2/2011 Cleland et al.
8,056,451 B2 11/2011 Chervanek et al.
8,151,618 B2 * 4/2012 Polofsky ..... B25B 7/04 72/409.01
8,516,931 B2 * 8/2013 Steele ..... B25B 7/10 81/409
8,584,335 B2 * 11/2013 Tsang ..... B25B 5/12 269/266
8,677,866 B2 * 3/2014 Steele ..... B25B 7/04 72/413
2003/0007830 A1 * 1/2003 Bang ..... B25G 3/18 403/327
2010/0005934 A1 * 1/2010 Guilbault ..... B25G 1/04 81/177.2
2010/0018365 A1 * 1/2010 Tyler ..... B25B 5/163 81/423
2010/0050826 A1 * 3/2010 Fan ..... B25B 7/04 81/386
2011/0302764 A1 * 12/2011 Smith ..... B25B 7/02 29/505
2012/0180607 A1 * 7/2012 Chen ..... B25B 7/04 81/423
2012/0255401 A1 * 10/2012 Wang ..... B25B 7/18 81/423
2014/0208898 A1 * 7/2014 Lesche ..... B25B 5/147 81/423
2014/0263031 A1 * 9/2014 Lawson ..... B25G 3/26 210/470
2015/0000478 A1 * 1/2015 Zeng ..... B25B 7/08 81/423

* cited by examiner

GRIPPER TOOL WITH MULTI-FUNCTION ATTACHMENTS

CROSS REFERENCE TO RELATED APPLICATIONS

This application claims the benefit of U.S. Provisional Application No. 61/846,979 filed Jul. 16, 2013 entitled Gripper Tool with Multi-Function Attachments which is hereby incorporated by reference in its entirety.

FIELD OF THE INVENTION

The present invention is a multi-functional hand tool that has releasable tool attachments that affix to a pair of articulating handles that provide for gripping, rotating, twisting, cutting, pounding, and performing other functions commonly done using a number of different tools. The invention is further related to a multi-functional hand tool that may twist, grip or otherwise manipulate a workpiece, without damage or marring of the workpiece.

BACKGROUND OF THE INVENTION

Hand tools of infinite varieties to grip, cut, pound, twist, and perform other functions are well known. Vise grips or other locking pliers provide a mechanism to grip and secure a work piece between a set of jaws. The jaws are normally partially rounded to fit around a pipe or stud and may be knurled or have ridges or grooves to grip the workpiece. An adjustment screw sets the distance between the jaws and a locking mechanism may be set by closing the pliers around a workpiece. However, in rotating or twisting the jaws around, the pipe, stud or other workpiece, the workpiece may be marred, crushed or otherwise damaged. What is needed is a gripping tool that may rotate, twist or otherwise manipulate a workpiece without damage.

Tool attachment pieces having different functions or sizes such as screwdriver heads, sockets, and wrenches are also known with the piece being releasably affixed to a single handle. These devices provide for a single tool to be multi-functional. What is not known is a multi-function tool having tool attachments that releasably mount on a pair of articulating handles as described in the present invention.

SUMMARY OF THE INVENTION

The present invention is related to a multi-function tool having releasable tool attachments that affix to a pair of articulating handles that provide for gripping, rotating, twisting, cutting, pounding, and performing other functions commonly done using a number of tools each having a different function.

It is an object of the invention of the multi-function tool to adjust and automatically lock to a suitable distance to use a releasable tool attachment.

It is a further object of the invention of the multi-function tool to easily access a release trigger to disengage and unlock the multi-function tool to have the handles move freely to any preferred distance.

It is a further object of the invention that the range of distance of the multi-function tool is set by a threaded butterfly nut.

It is a further object of the invention that the multi-function tool has a pair of matching tools attachments such as pliers, pipe holders and other mirrored releasable attachments to grip, rotate, twist and otherwise manipulate a workpiece.

It is a further object of the invention that the multi-function tool may have a single tool attachment such as a hammer, wrench, screw driver, nut driver, socket, saw, or other releasable attachment to pound, turn, cut or otherwise manipulate a workpiece.

It is a further object of the invention that the multi-function tool may have a mismatched pair of tools attached such as a hammer and saw or any other releasable attachments to perform different tasks on a workpiece.

It is a further object of the invention that various sizes of tool attachments are offered to meet standard sizes, such as a range of pipe holder tool attachments having inner diameters sized to standard outer diameter pipe sizes, so a properly sized tool attachment may be selected for a particular pipe, similar to selecting a proper socket size.

It is a further object of the invention to provide mated stud removal tool attachments that may securely hold and twist or break a stud without slippage for removal as required.

It is a further object of the invention that the tool mount and/or tool block that secures the tool attachment to the multi-function tool is repairable using a removable plug and replaceable spring assembly.

The present invention is related to a multi-function tool comprising a first handle; an articulating arm pivotally connecting the first handle to a second handle; first and second tool mounts affixed to each of the first handle and the articulating arm; at least one tool attachment releasably attached to one or more of the first and second tool mounts; and a quick release mechanism to remove the tool attachment. The quick release mechanism of the multi-function tool may be a spring assembly and the spring assembly of the quick release mechanism is replaceable. The multi-function tool further comprises a butterfly nut to set a range of distance between the first and second handle. The multi-function tool further comprises a locking mechanism to automatically lock the first and second handle at a set distance. The multi-function tool further comprises a trigger to release the locking mechanism to freely move the first and second handles. The multi-function tool may have mirrored tool attachments installed on the first and second tool mounts to grip a workpiece with the automatic locking mechanism preventing damage to the workpiece. The tool attachments of the multi-function tool may be in standard dimensioned sizes.

The multi-function tool may further comprise a stud removal tool attachment.

The present invention is further related to an automatically locking hand tool comprising a first handle pivotally connected to an articulating arm, the first handle having a tool attachment; a second handle pivotally connected to the articulating arm, the second handle having a tool attachment; a brace extending between the first and second handle, the brace supporting a crescent gear; a spring attached to the crescent gear pulling the crescent gear towards a locking pin; and the locking pin may engage the crescent gear and set a specific distance between the first and second handle. The automatically locking hand tool may include tool attachments that are replaceable using a quick release tool attachment fixture. The quick release tool attachment fixture of the automatically locking hand tool may be repairable. The automatically locking hand tool provides for tool attachments having different functions to be installed to the first and second handles. The automatically locking hand tool further comprises a trigger to release the locking mechanism. The automatically locking hand tool further comprises a butterfly nut to set a range of distance between the first and second handle.

The present invention is further related to a method of manufacture of an automatically locking hand tool comprising the steps of pivotally connecting a first handle to an articulating arm, the first handle having a tool attachment; pivotally connecting a second handle to the articulating arm, the second handle having a tool attachment; extending a brace between the first and second handle; supporting a crescent gear with the brace; attaching a spring to the crescent gear to pull the crescent gear towards a locking pin; and engaging the locking pin to the crescent gear to set a specific distance between the first and second handle. The method of manufacture of an automatically locking hand tool further comprises replacing tool attachments using a quick release attachment fixture. The method of manufacture of an automatically locking hand tool further comprises repairing the quick release attachment fixture. The method of manufacture of an automatically locking hand tool further comprises actuating a trigger to release the locking mechanism. The method of manufacture of an automatically locking hand tool further comprises setting a range of distance between the first and second handle using a butterfly nut.

These and other features, advantages and improvements according to this invention will be better understood by reference to the following detailed description and accompanying drawings.

BRIEF DESCRIPTION OF THE DRAWINGS

Several embodiments of the present invention will now be described by way of example only, with reference to the accompanying drawings in which.

DETAILED DESCRIPTION OF THE DRAWINGS

Figure 1A:
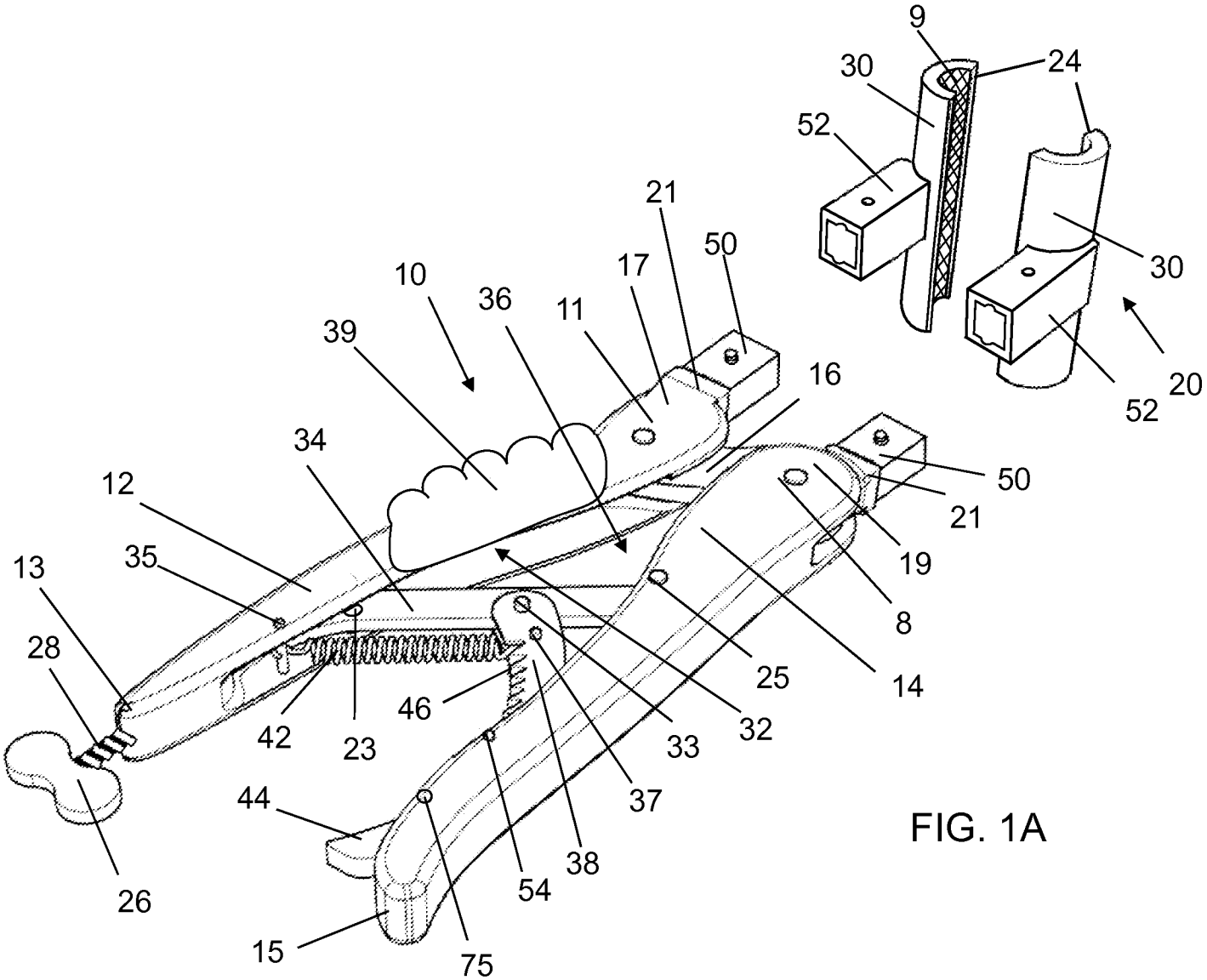
FIG. 1A is a perspective view of an embodiment of the multi-function tool of the present invention and a detachable tool attachment.
Figure 1B:
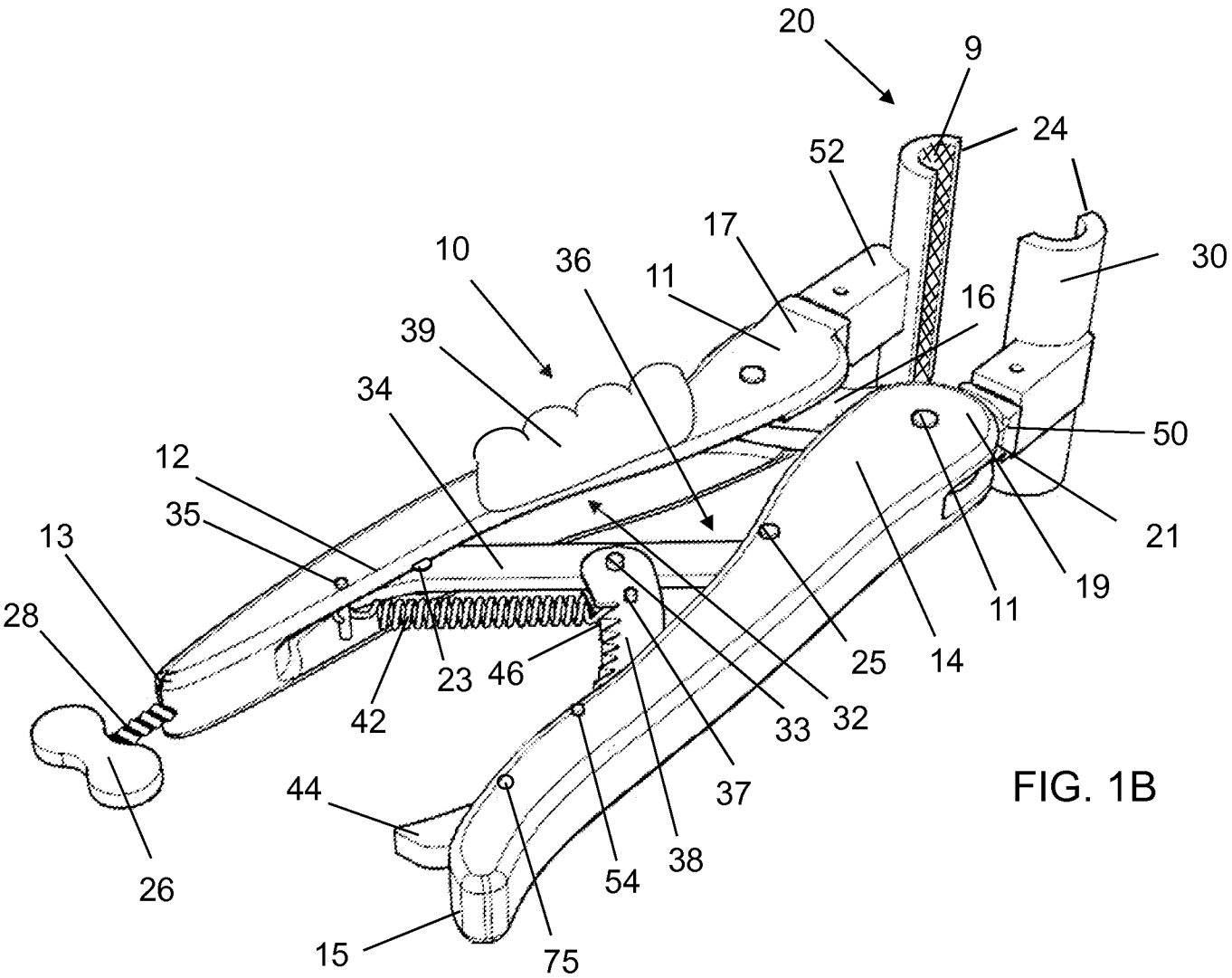
FIG. 1B is a perspective view of an embodiment of the multi-function tool of the present invention having the detachable tool attachment attached to the multi-function tool.

In an embodiment of the present invention, the gripper multi-function tool 10 has a gripper handle 12 and a support handle 14 as shown in FIG. 1A. The handles 12 and 14 are pivotally attached to an articulating arm 16 using rivets 11, screws or other attachment hardware so that when separating each base 13 and 15 of the handles 12 and 14, the tips 17 and 19 are brought together. At the tip 17 of the gripper handle 12, a tool mount 50 provides for tool attachments 20 that have different types of features and functions to be releasably attached. The tool mount 50 may be affixed to a reinforced support rim 21 at the tip 17 and a second tool mount 50 may be affixed to or be formed on a rim 21 along the upper portion of the articulating arm 16 as shown. Alternatively, a tool mount 50 may be affixed or formed along a rim of the tip 19 of the support handle 14. Each tool attachment 20, shown in a first embodiment as a pair of pipe holders 30 affixed to an attachment tool block 52 slide over or into the tool mount 50 and are secured to the gripper multi-function tool 10, as shown in FIG. 1B. The tool attachments 20 provide for gripping, rotating, twisting, cutting, pounding, and performing other functions commonly done using a variety of different tools. The pipe holders 30 or other tool attachments 20 may have knurled surfaces 9, ridges, or grooves to assist in grabbing and holding a workpiece. In further embodiments, the tool attachments 20 may be permanently affixed to the handles 12 and 14 and/or a handle and the articulating arm 16.

Figure 2:
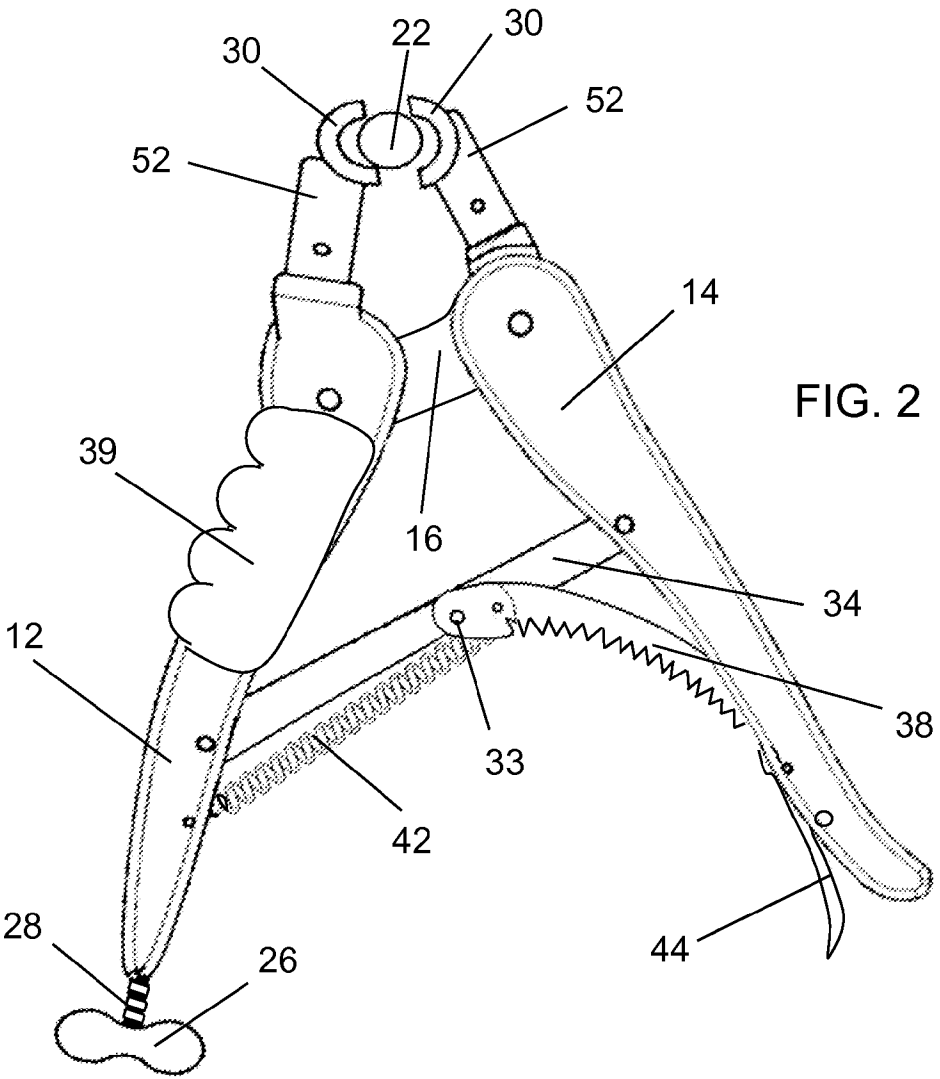
FIG. 2 is a side view of the embodiment of the present invention in a closed position holding a workpiece.

As the handles 12 and 14 are pulled apart to a specific distance, the tips 17 and 19 move from a further distance apart to a closer distance that may allow the faces 24 of the tool attachments 20 to touch. The distance between the tips 17 and 19 of the handles 12 and 14 and faces 24 of the tools attachments 20, if two attachments 20 are installed, is set by a butterfly nut 26 and crescent gear 38 that includes a locking mechanism 44. In an embodiment, the butterfly nut 26 is inserted through the base 13 of the gripper handle 12 and along a channel 32 or groove formed within the handle 12. The butterfly nut 26 supports a brace 34 that has a first end portion aligned within the gripper handle channel 32 with the brace 34 resting on or affixed to the top of the adjustment screw 28 of the butterfly nut 26 using a pin 23, or other attachment hardware within the channel 32. The pin 23 has a flat face that is level or below the surface of the brace 34 so that the brace 34 may slide freely within the channel 32 of the gripper handle 12. The brace 34 has a second end portion that extends from the channel 32 of the gripper handle 12 to within a channel 36 or groove of the support handle 14. The brace 34 is similarly attached using a rivet 25, screw or other attachment hardware to a mid-portion of the support handle 14. By loosening or tightening the butterfly nut 26, the brace 34 moves within channels 32 and 36 of the handles 12 and 14 and sets a distance between the handles 12 and 14. As the handles 12 and 14 are pulled further apart through this adjustment, the distance between the tips 17 and 19 and faces 24 of the tool attachments 20 are adjusted from a fully open position to a closed position where the faces 24 of the tool attachments may touch or almost touch and surround a workpiece 22 as shown in FIG. 2.

Figures 3A, 3B, 3C:
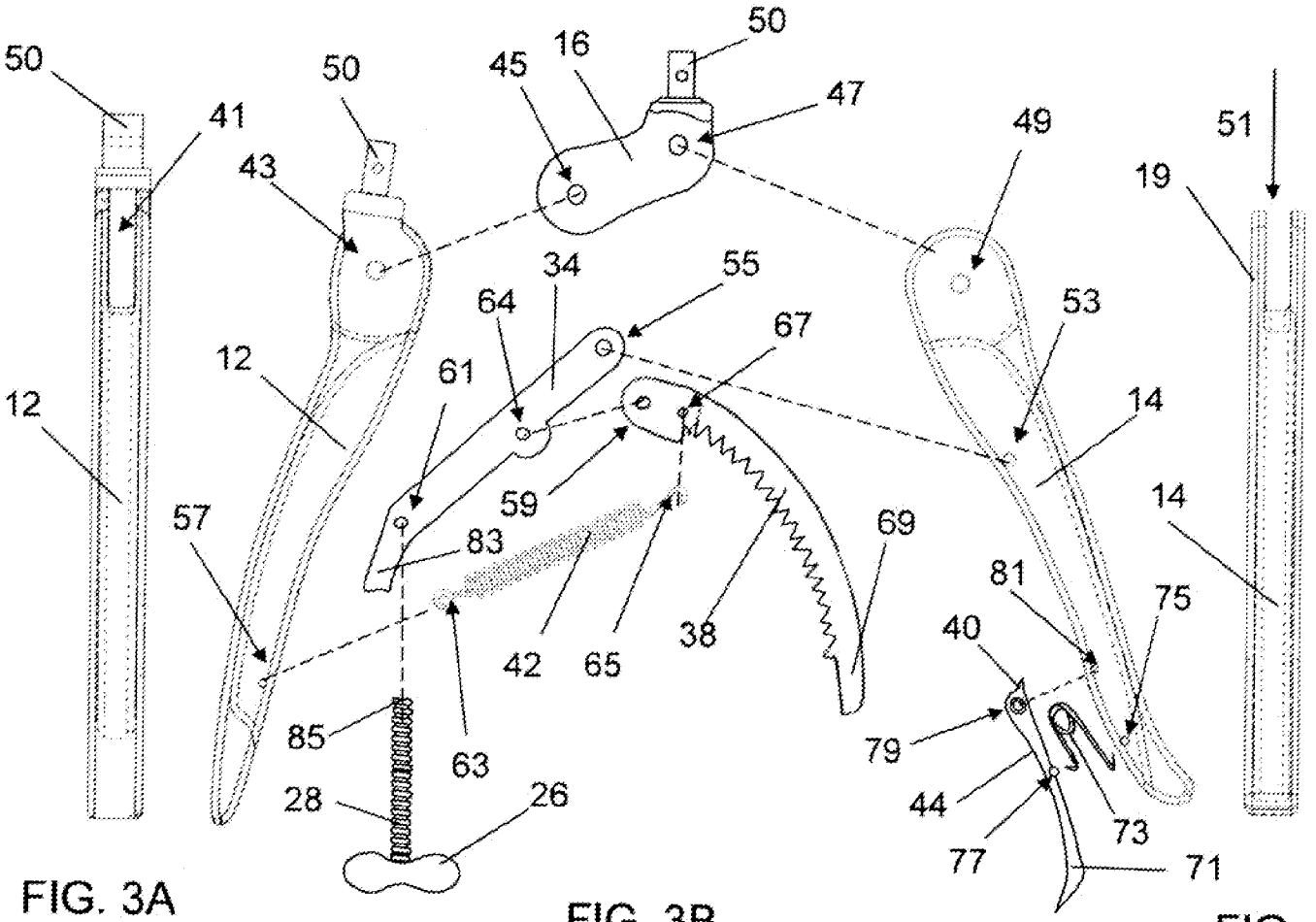
FIG. 3A is an end view of an embodiment of a gripper handle of an embodiment of the multi-function tool of the present invention.
FIG. 3B is an exploded view of an embodiment of the multi-function tool of the present invention.
FIG. 3C is an end view of an embodiment of a support handle of the embodiment of the multi-function tool of the present invention.

A side view of the gripper handle 12 is shown in FIG. 3A showing a slot 41 that is formed in the upper portion of the handle 12 below the tool mount 50. The articulating arm 16 is inserted in the slot 41 and a rivet 11 or screw is inserted through an opening 43 in the handle 12 and an opening 45 in the articulating arm 16 as shown in FIG. 3B. The articulating arm 16 is also inserted in a slot 51 at the tip 19 of the support handle 14 as shown in FIG. 3C. A rivet 11 or screw is inserted through an opening 49 in the support handle 14 and through a second opening 47 in the articulating arm 16 to attach the articulating arm 16 to the support handle 14. The brace 34 is attached to the support handle 14 using a rivet 25 or screw through a second opening 53 along the mid-portion of the support handle 14 and an opening 55 in the brace 34. The other end of the brace 34 is attached to or supported by the butterfly nut 26 using a pin 23 or other device that is inserted through an opening 61 in the brace 34.

The crescent gear 38 or ratchet attaches to the brace 34 using a rivet 33 or other attachment device with the opposing end of the gear 38 extending within the support channel 36. A spring 42 is affixed to the gripper handle 12 using pin 35 and to the crescent gear 38 using pin 37. The spring 42 maintains tension on the crescent gear 38 and holds the brace 34 in alignment within the channels 32 and 36. The spring 42 applies sufficient force to the crescent gear 38 to pull the teeth 46 of the gear against the locking mechanism 44 when opening or closing the handles 12 and 14. Each end of the spring 42 may be formed as a hook with a first end 63 inserted into the gripper handle channel 32 and looped or otherwise connected to a pin 35 that is inserted through an opening 57 along a lower portion of the gripper handle 12. The other hooked end 65 of the spring 42 is looped through an opening 67 along an upper mid-portion of the crescent gear 38. An opening 59 at the end of the crescent gear 38 is aligned with an opening 64 along the mid-portion of the brace 34 to attach the brace 34 to the crescent gear 38 using a rivet 33, screw or other attachment device. The opposing end 69 of the crescent gear 38 is inserted into the support handle channel 36 behind the locking mechanism 44. The locking mechanism 44 has a locking pin 40 formed as a wedged end that is inserted in between and rides along the teeth 46 of the crescent gear 38. The spring 42 pulls the teeth 46 of the crescent gear 38 against the locking pin 40 so that at any point where the teeth 46 and wedged end 71 mesh a distance between the handles 12 and 14 is set and locked holding the tips 17 and 19 of the handles 12 and 14 at a set distance. A trigger 71 is formed by the extended end of the locking mechanism 44 and a wire spring 73 is installed on a pin 75 within the support handle 14 and a pin 77 positioned along the trigger 71 to force the locking pin 40 against the teeth of the crescent gear 38. Pushing the trigger 71 towards the support handle 14 disengages the locking pin 40 from the teeth 46 so that the handles 12 and 14 can open and close freely. An opening 79 through the locking mechanism 44 is aligned with an opening 81 in the support handle 14 and the locking pin 40 is meshed with the crescent gear 38 and inserted into the support handle channel 36. The locking mechanism 44 is connected to the support handle using a rivet 54 or other attachment device to the support handle 14.

Figure 4B:
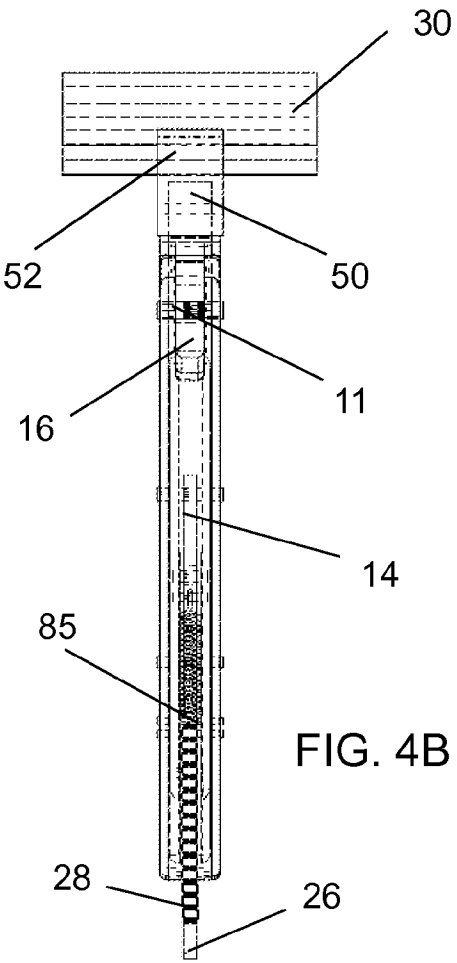
FIG. 4B is an internal end view of an embodiment of the multi-function tool of the present invention.
Figure 4A:
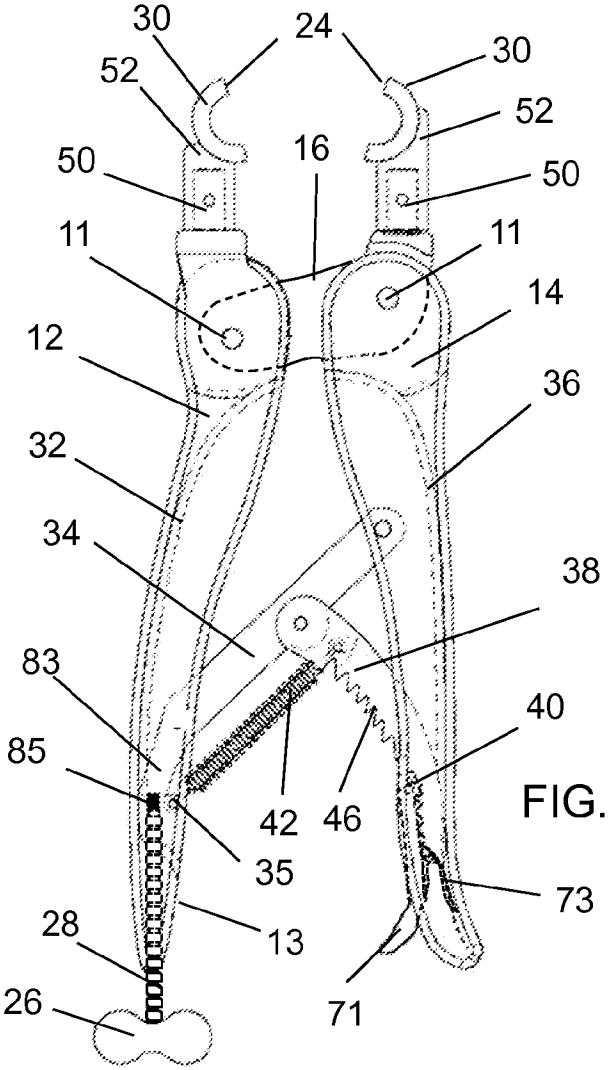
FIG. 4A is an internal side view of an embodiment of the multi-function tool of the present invention in an open position.
Figure 5B:
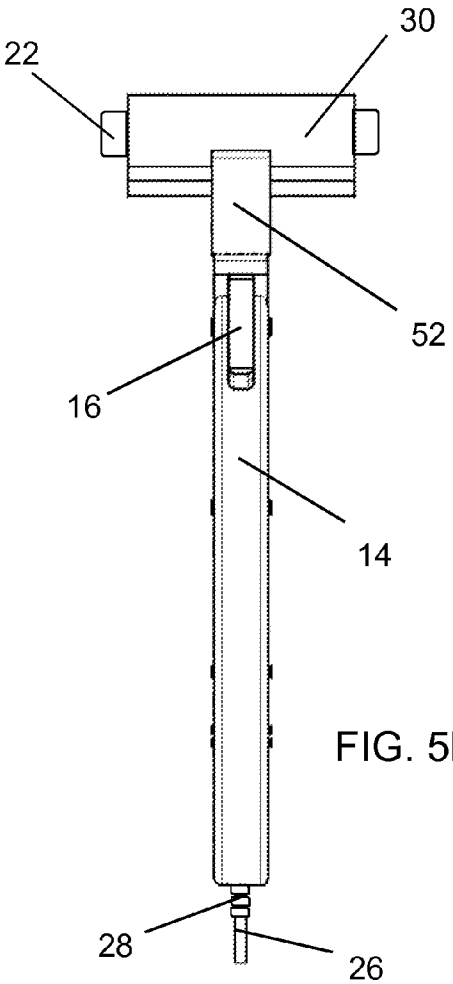
FIG. 5B is an end view of an embodiment of the multi-function tool of the present invention in a closed position holding a workpiece.
Figure 5A:
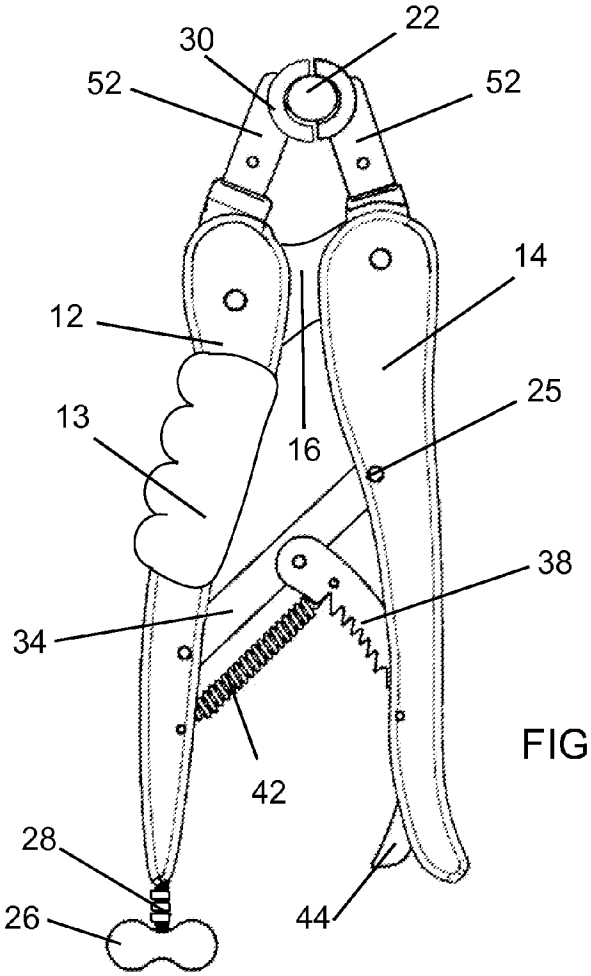
FIG. 5A is a side view of an embodiment of the multi-function tool of the present invention in a closed position holding a workpiece.

The range of movement of the crescent gear 38 may be set by the amount that the threaded portion 28 of the butterfly nut 26 is screwed into the base 13 of the handle 12 where the end 83 of the brace 34 is attached to the end 85 of the threaded portion 28 using a pin 23 or in further embodiments, the end 83 of the brace 34 rests without attachment on the end of the threaded portion 28 as shown in FIGS. 4A and 4B. Contact between the brace 34 and threaded portion 28 is maintained because of the narrow channel 32 of the gripper handle 12 and the spring pin 35 that secures the spring to the handle 12. The handles 12 and 14 are adjusted to a range of distances using the butterfly nut 26 by moving the brace 34 to limit or extend the amount of travel of the crescent gear 38 along the locking pin 40. A specific distance between the tool attachments 20 is set by the automatic locking of the crescent gear 38 using the locking mechanism 44. By holding the trigger 71 of the locking mechanism 44 with a single finger, the locking pin 40 rides freely along the crescent gear 38. By releasing the trigger 71, the tool automatically locks the handles 12 and 14, and the faces 24 of the tool attachments 20 at a specific distance apart from one another. This provides for a tool attachment 20 like the pipe holder 30 to surround and grip a pipe without crushing the pipe because the faces 24 of the tool attachment 20 are locked at a set distance, as shown in FIGS. 5A and 5B. In the locked position, the gripper and support handles 12 and 14 are prevented from being further compressed until the trigger 71 is actuated by pulling the trigger 71 close to the support handle 14 to disengage the locking pin 40 from the teeth 46 of the crescent gear 38. By holding the trigger 71 close to the handle 14, the multi-function tool 10 freely open and closes to adjust the distance between the tool attachments 20 to better, grab, twist and turn a workpiece 22 as required.

The multi-function gripper tool 10 with adjustable locking handles may have a number of different types of tool attachments 20 with each tool attachment 20 having a tool block 52 that has sidewalls 64 that form an opening that is slightly larger or smaller in dimension than the tool mount 50 so that the tool block 52 can be slid tightly over or into the tool mount 50. The tool mount 50 is formed on or affixed to one or both handles 12 and 14 or alternatively is formed on or affixed to one handle and on or affixed to the articulating arm 16. In a first embodiment, as shown FIGS. 6A to 6D, the tool mount 50 is formed or affixed on one side of the upper surface 48 of the articulating arm 16. The tool mount 50 may extend from the surface 56 of the articulating and be of the same thickness as the articulating arm 16 or be thicker or thinner in dimension than the width of the articulating arm 16. The rim 21 of the upper portion of the articulating arm 16 may be a reinforced support to strengthen the attachment of the tool mount 50. In an embodiment, the tool mount 50 has sidewalls 58 that form a box or other shape matching the tool block 52 of the tool attachment 20.

Figure 6B:
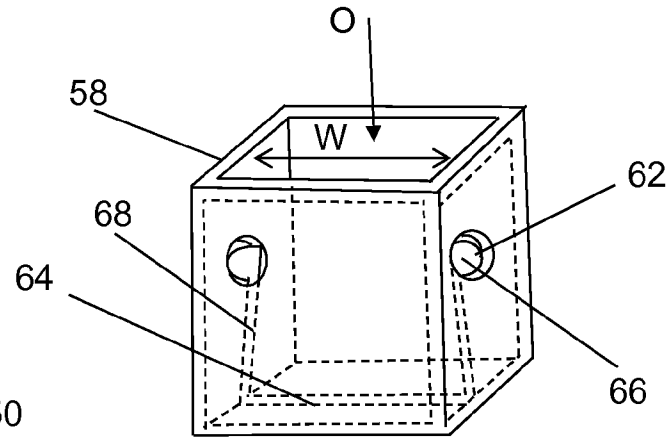
FIGS. 6A-6D are perspective views of an embodiment of a quick release tool attachment fixture using a snap clip used to secure the tool attachments to the multi-function tool in an embodiment of the present invention.
Figure 6D:
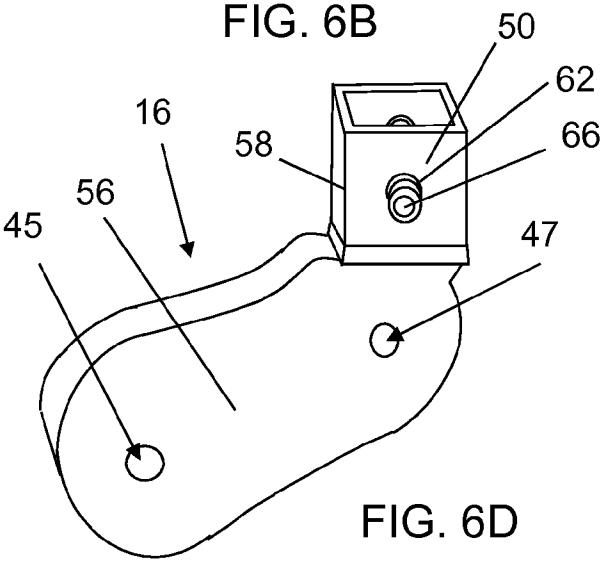
Figure 6A:
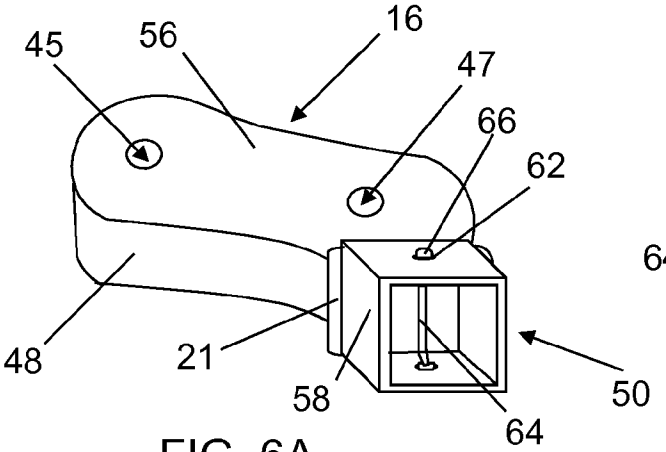
Figure 6C:
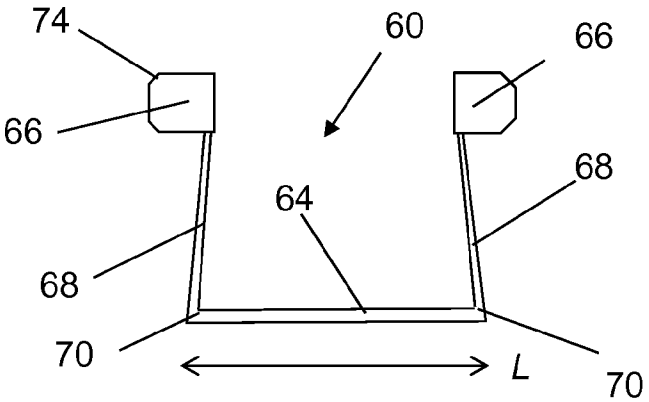

In two of the sidewalls 58 of the tool mount 50 a hole 62 is formed with each of the holes aligned together along an axis that is perpendicular to the surface 56 of the articulating arm 16. The box shape of the tool mount 50 forms an opening O that a metallic or resilient flexible plastic snap clip 60 may be inserted into as shown in FIG. 6B. The snap clip 60 may be a flat or wire spring that has a stiff, resilient bar 64 that extends to a length L that is minimally shorter than the internal width W between the sidewalls 58 that have the two holes 62. The snap clip 60 has a pair of quick release buttons 66 that are each supported on a flexible member 68 connected to each end 70 of the bar 64. The snap clip 60 flexible members 68 are formed under tension that forces the flexible members 68 to a near perpendicular position approximating a 90 degree angle from the bar 64. However, as shown in FIG. 6C, the flexible members 68 may be compressed to draw the quick release buttons 66 together. When inserted in the tool mount 50 or alternatively in the tool block 52 of the tool attachment 20 the quick release buttons 66 are of sufficient length to extend a distance out of the holes 62, as shown in FIG. 6D, and into holes 76 formed in the sidewalls 78 of the tool block 52 of a tool attachment 20 as shown in FIGS. 7A-7D.

The holes 62 in the tool mount 50 are in the two sidewalls 58 that are aligned with the sides of each handle 12 and 14 and that are perpendicular to the face 24 of the tool attachments 20 such as the pipe holder 30. This orientation reduces the shearing force of the tool attachment 20 as the multi-function tool 10 is manipulated to grasp a pipe, tighten a bolt, pound a nail or used as a saw tool attachment to cut a workpiece 22. The edge 74 of the quick release button 66 may be rounded or beveled to provide for the tool block 52 to easily slide over the tool mount 50 to compress the quick release buttons 66. Semi-circular cutouts 87 along the edge of the base 86 where the holes 76 are positioned in the sidewalls 78 of the tool block 52 also help to facilitate sliding of the tool block 52 over the tool mount 50 and the alignment and compression of the quick release buttons 66. In sliding the tool block 52 over the tool mount 50, the holes 76 in the tool block 52 align with the holes 62 in the tool mount 50 and the flexible members 68 snap outwards to force the quick release buttons 66 through the openings 62 and 76 and secure the tool block 52 with tool attachment 20 to the tool mount 50 of the multi-function tool 10. The snap clip 60 is formed from sturdy resilient steel that sufficiently secures the tool attachment 20 providing for the multi-function tool 10 to be used for many different types of work. By compressing the quick release buttons 66, the beveled edge 74 provides for a tool attachment 20 to be pulled and be removed from the multi-function tool 10. A beveled round 89 may also be formed below the openings 76 in the tool block 52 to assist in the compression of the quick release buttons 66 and the removal of the tool attachment 20.

Figures 8A, 8B:
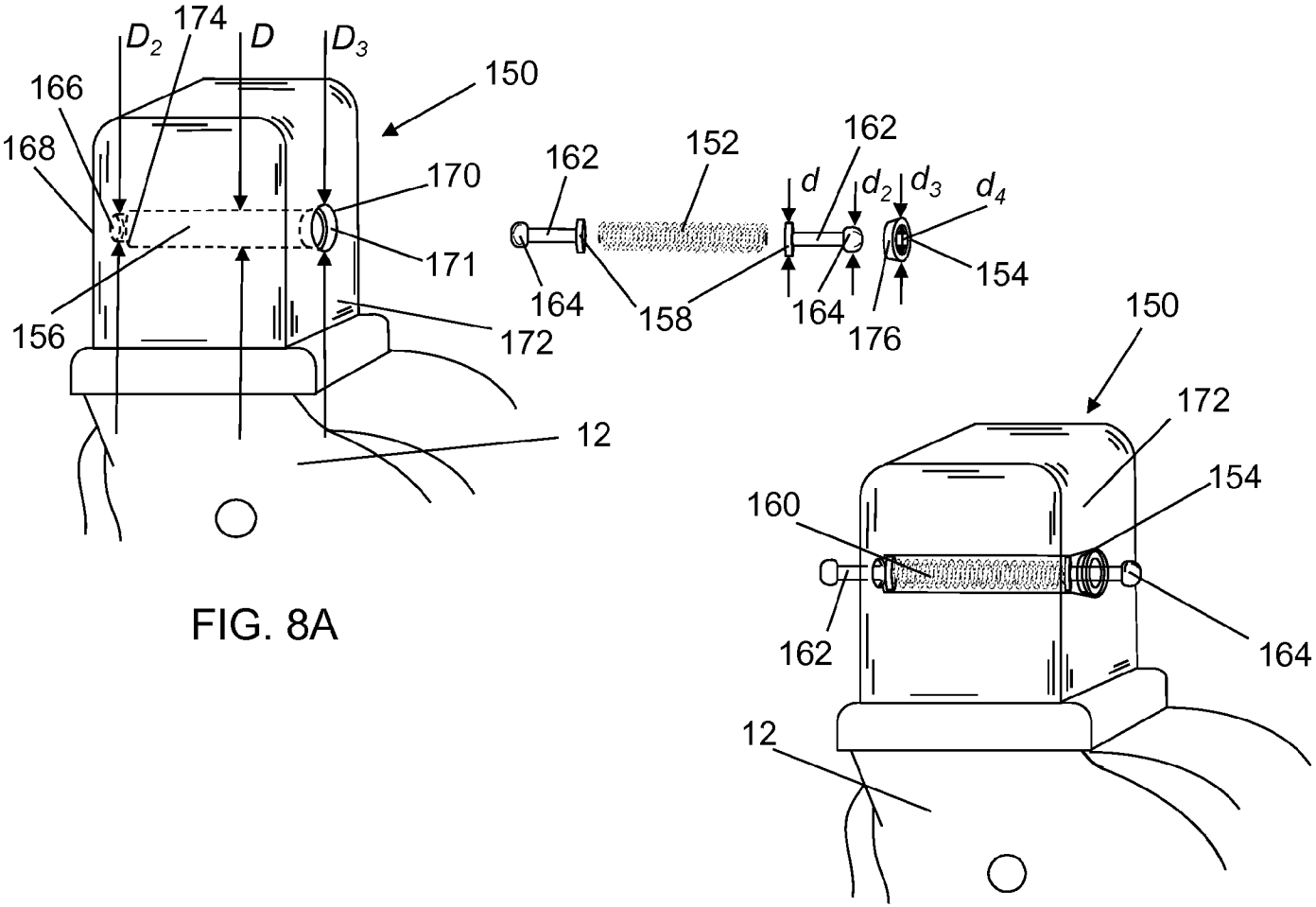
FIG. 8A-8D are perspective views of a further embodiment of a quick release tool attachment fixture with a repairable spring assembly to secure the tool attachments shown as a pipe holder tool attachment in an embodiment of the multi-function tool of the present invention.

In a further embodiment, as shown in FIGS. 8A and 8B, a tool mount 150 having a spring 152 and a press fit plug 154 provides for components of the multi-function tool 10 to be repaired or replaced if damaged. The components of the multi-function tool 10 including the handles, tool mount and tool attachments are made of tool grade steel, of another resilient metallic material, or of a hard plastic composite with the tool mount 150 in this embodiment being a solid piece. A bore hole 156 is drilled through the solid tool mount 150. The bore hole 156 has a main diameter D that is slightly larger than the diameter d of end plates 158 that are affixed to each end of the spring 152. The end plates 158 are larger in diameter than the diameter of the spring 152 and form the widest portions of the spring assembly 160 that includes the spring 152, the end plates 158, support extensions 162 and ball ends 164. A support extension 162 is affixed to each end plate 158 and the ball end 164 may be formed or affixed to each support extension 162. A second bore hole 166 is formed from the sidewall 168 of the tool mount 150 to connect with the first bore hole 156. The second bore hole 166 has a diameter $D_2$ that is only slightly larger than the ball end diameter $d_2$, the ball end diameter $d_2$ being smaller than the end plate diameter d and having the same or a larger diameter than the support extension 162. A third opening 170 is formed on the opposing sidewall 172. The third opening 170 at its smallest has the same diameter D as the first bore hole 156, and extends to a larger diameter $D_3$ at the outer wall 172 of the opening creating a slanted surface such as a countersink or bevel 171 for the end plug 154 to press fit into the opening 170. The end plug 154 having an outer diameter $d_3$ that is minimally smaller than the longest diameter $D_3$ of the opening 170 to create a frictional fit of the end plug 154 and tool mount 150. The end plug 154 has an inner diameter $d_4$ that is larger in diameter than the ball end diameter $d_2$.

To install the quick release tool attachment fixture within the tool mount 150, the spring assembly 160 is inserted into the third beveled opening 170 through the sidewall 172. The ball end 164 and support extension 162 of the spring assembly 160 fit through both the diameter D of the first bore hole 156 and through the diameter $D_2$ of the second bore hole 166. The end plate 158 is stopped at the rim 174 formed by the change in diameter of the first and second bore holes 156 and 166. When fully inserted as shown in FIG. 8B, the opposing end plate 158 is approximately at the change in diameter that begins at the bevel of the third opening 170. The end plug 154 is press fit into the third opening 170 with the tapered edges 176 of the end plug 154 frictionally sealing against the bevel 171 formed in the opening 170. A small amount of force may be required to compress the spring 152 where the spring tension forces one end plate 158 against the end plug 154 and the other end plate 158 against the rim 174 at the change in diameter of the bore holes 156 and 166. This spring tension forces the support extensions 162 and end balls 164 to extend an adequate distance beyond the sidewalls 168 and 172 of the tool mount 50. The frictional fit of the end plug 154 adheres the plug in place, but is also removal to provide for the repair of the tool attachment fixture by inserted a rod (not shown) and pulling out the plug 154 if the spring 152 or support extension 162 is broken. By removing the end plug 154 the broken piece or the entire spring assembly 160 may be replaced and the end plug 154 may be reinstalled. This is a unique advantage where many hand tools do not provide a way to replace only broken components but instead require that the entire tool be replaced.

Figure 8D:
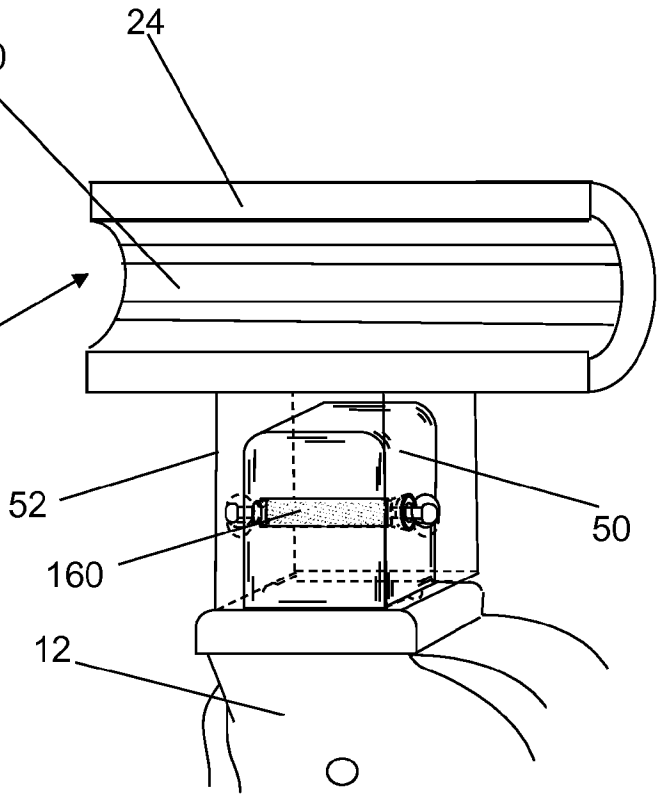
Figure 8C:
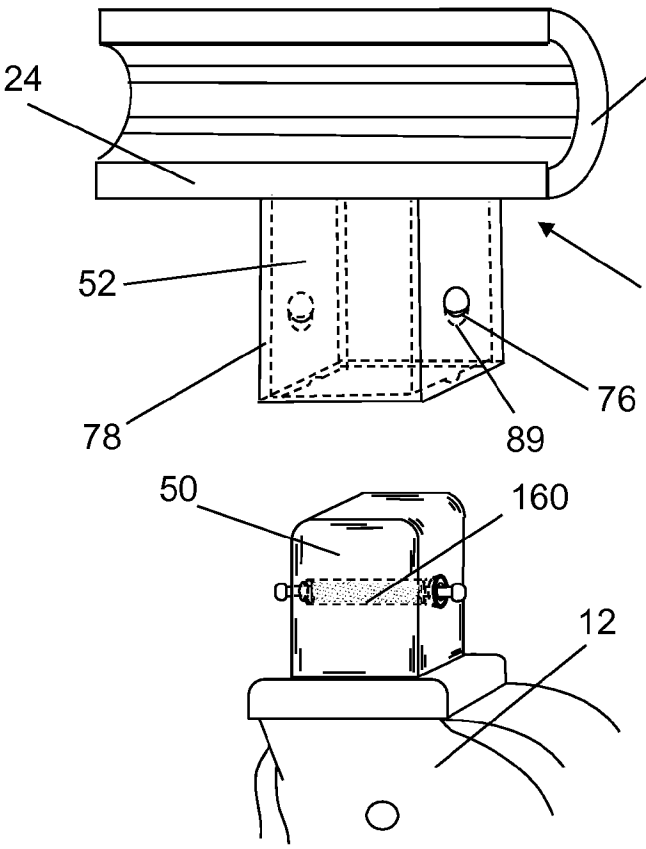

When assembled, the support extension 162 extends out of each of the openings 166 and 170 with the ball ends 164 of sufficient length to extend into the openings 76 of a tool block 52 as shown in FIGS. 8C and 8D. The spring 154 is of adequate spring force to expand and secure the ball ends 164 within the tool block 62 to sufficiently secure the tool attachment 20 to the multi-function tool 10 and provide a quick release of the tool attachment 20 by compressing the ball ends 164 and spring 152 to pull the tool attachment 20 off of the tool mount 150. Each variety of tool attachment 20 has the tool block 52 with sidewalls 78 that are dimensioned to form an opening that is only slightly larger than the outer dimension of the tool mount 150 with one or more holes 76 positioned and corresponding to the openings 166 and 170 in the sidewalls 168 and 172 of the tool mount 150. The secure attachment prevents slippage or movement of the tool attachment 20 and provides for gripping, rotating, pulling, cutting, pounding and otherwise manipulating the tool attachment 20 to tighten, adjust or remove a workpiece or perform other tasks using the multi-function tool 10. The easy removal of the tool attachment 20 by compressing the quick-release buttons 66 and snap clip or ball ends 164 and spring 152 and pulling the tool attachment 20 away from the multi-function tool 10 provides for a number of tool attachments 20 to be available to perform a job such as manufacturing assembly, auto repair, plumbing repair, electronics repair and other tasks normally performed using a number of tools. In further embodiments, the articulating movement of the handles 12, 14 allows for a tool attachment such as the pipe holder 30 to be permanently attached to the handles.

Figure 7A:
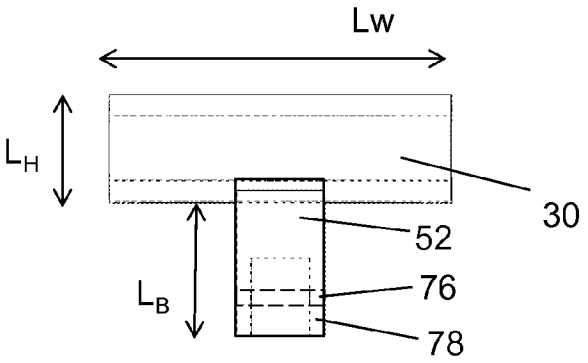
FIG. 7A is a side view of an embodiment of a pipe holder releasable tool attachment for an embodiment of the multi-function tool of the present invention.
Figure 7B:
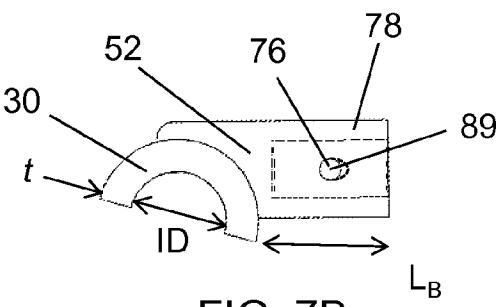
FIG. 7B is an end view of an embodiment of the pipe holder releasable tool attachment for an embodiment of the multi-function tool of the present invention.
Figure 7C:
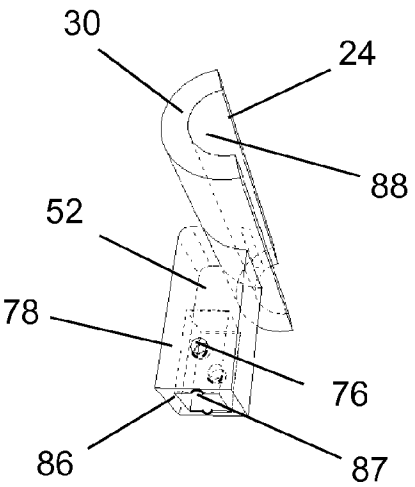
FIGS. 7C and 7D are perspective views of an embodiment of matching the pipe holder releasable tool attachments to be used together for an embodiment of the multi-function tool of the present invention.
Figure 7D:
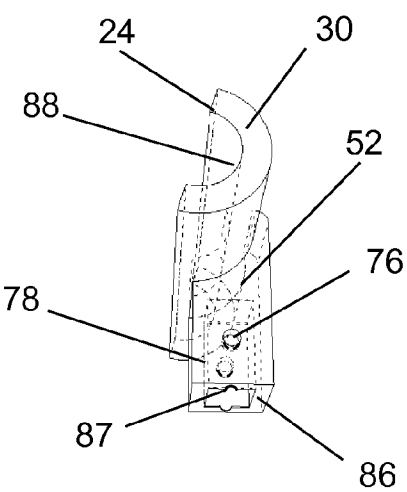
Figure 9:
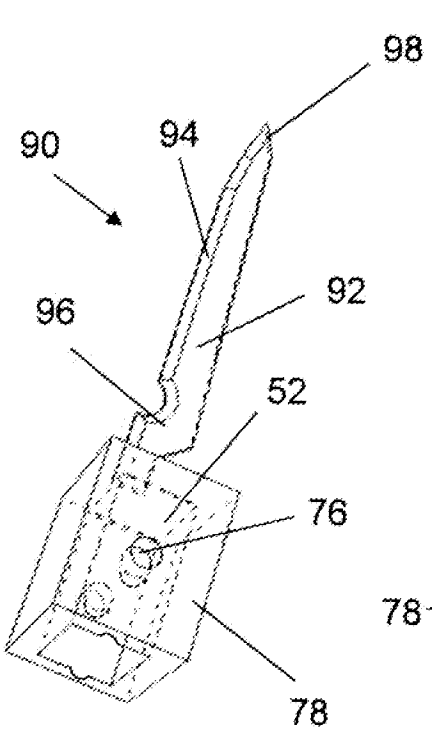
FIG. 9 is a perspective view of a further embodiment of releasable tool attachment as mated needle nose pliers to be used together for an embodiment of the multi-function tool of the present invention.
Figure 9:
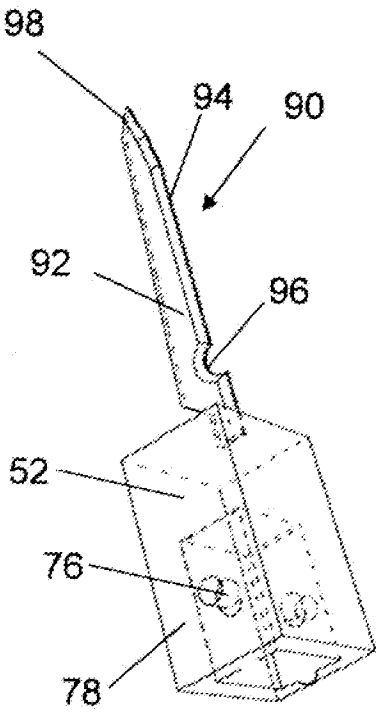

The releasable tool attachments 20 may include the pipe holder 30 that prevents damage to a pipe by adjusting the distance between the faces 24 of the tool attachment 20 using the crescent gear 38 and butterfly nut 26 so that the pipe rests undamaged in the cradle 88 of the pipe holder 30. The tool block 52 of the tool attachment 20, as shown in FIG. 7A, may be of any length $L_B$ necessary to have the tool attachment 20 extend into tight areas. The height $L_H$ and width $L_W$ of the tool attachment 20 may also be of any suitable dimensions and similar in dimension to other hand tools. The inner diameter ID of the pipe holder 30, as shown in FIG. 7B, may be the same or slightly larger than an outer diameter of a standard size pipe. A number of pipe holders 30 of different standard pipe dimensions may be available to use with the multi-function tool 10 where the proper tool attachment 20 may be selected and easily installed to use on any standard size pipes. The wall thickness t of the pipe holder 30 may be thicker for some tool attachments 20 in order to support larger pipes of heavier materials. The width $L_W$ may also be extended to provide adequate support to larger, heavier pipes. The shape of the pipe holder 30 may be a semi-circular curve, a square, or another shape to accommodate the shape of the workpiece 22. As shown in FIGS. 7C and 7D, the pipe holders 30 or as shown in FIGS. 9A and 9B, the needle nose pliers 90 or other paired tool attachments 20 may be mirrored or be identical with each one attached to a handle 12 or 14 or one attached to a handle 12 and the other attached to the articulating arm 16 as described so that the attachments 20 can be joined to grip, twist, pull or otherwise manipulate a workpiece 22. The needle nose plier tool attachment 90 may have jaws 92 with each jaw having a textured face 94 to grip and twist a connector or wired workpiece. The jaws 92 may have a pointed, curved or hooked end 98 or be of another shape to accommodate the workpiece and task required. A wire cutting tool 96 may be included to grasp and cut a wire by closing and twisting the handles of the multi-function tool 10.

Figure 10:
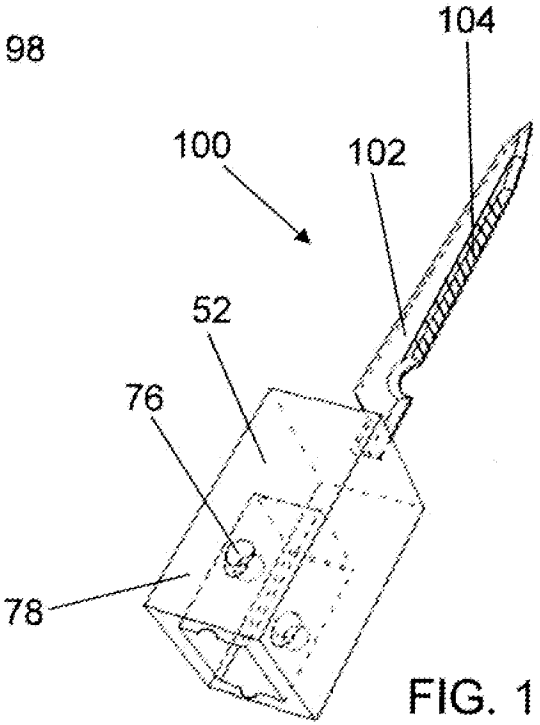
FIG. 10 is a perspective view of an embodiment of a releasable tool attachment as a saw blade for an embodiment of the multi-function tool of the present invention.

Other tool attachments 20 such as a saw 100 shown in FIG. 10 may work as a single tool and be installed on only one handle 12 or 14. The saw 100 has a blade 102 that has a series of teeth 104. Alternatively, two saw attachments 100 may be installed to more quickly slice through a workpiece 22 by easily adjusting the distance between the handles 12 and 14 and saw attachments 100 while cutting. Each blade 102 of the saw attachment 100 may cut through a portion of the workpiece and then one saw attachment 100 may be removed and a single saw attachment 100 can complete the cut. Other differently shaped saws, pliers, wrenches, screw drivers, nut drivers, sockets, and other attachments having a single part such as a hammer or mating parts such as pliers are all contemplated within the scope of the present invention, with the dimension of the handles 12 and 14, tool mounts 50, and tool attachments 20 appropriately sized to properly use and manipulate the workpiece.

Figure 12:
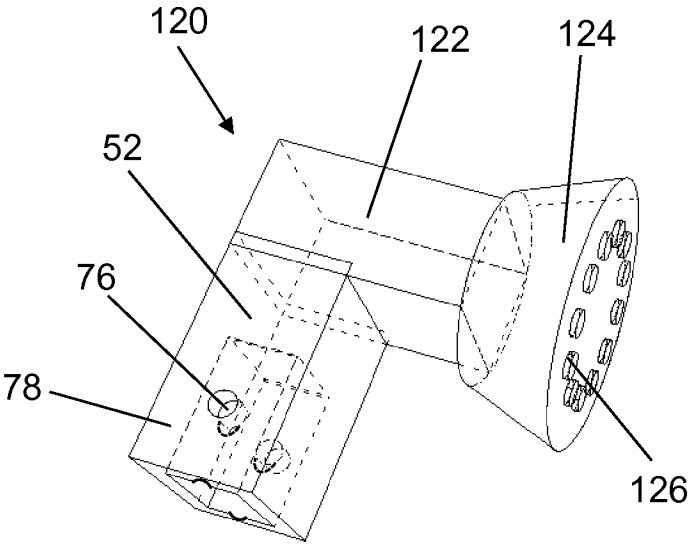
FIG. 12 is a perspective view of an embodiment of a releasable tool attachment as a hammer for an embodiment of the multi-function tool of the present invention.
Figure 11:
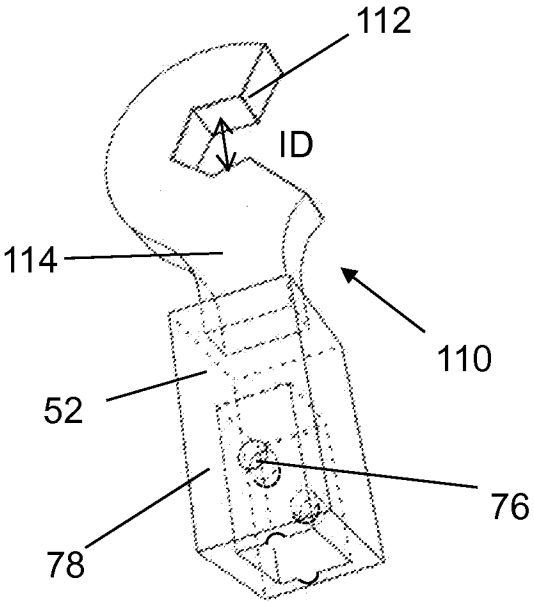
FIG. 11 is a perspective view of an embodiment of a releasable tool attachment as a wrench for an embodiment of the multi-function tool of the present invention.

Another tool attachment 20, a wrench 110 is shown in FIG. 11. The inner diameter ID of the wrench 110 may be of any standard size in order to select and easily replace the tool attachment 20 to appropriately match the size of specific hardware or a workpiece. The hammer 120, as shown in FIG. 12 may have a perpendicular extension 122 to the tool block 52 to orient the hammer head 124 so that in gripping the handles 12 and 14 in a closed position, a workpiece 22 such as a nail, screw or other object may be properly struck. The hammer head 124 may have a knurled or cushioned surface 126 to protect a workpiece 22 when striking. The multi-function tool 10 may provide for non-mating or dissimilar tool attachments 20 to be installed on the handles 12 and 14 at the same time. For example, in removing a wedged pipe that requires both cutting and pounding, the saw 100 and hammer 120 tool attachments 20 may be installed in opposing directions. The handles 12 and 14 of the tool 10 are then simply rotated in one direction facing the workpiece 22 to use the cutting tool attachment 100 or rotated oppositely to use the hammer attachment 120 removing the requirement to stop work to re-attach a new tool to complete a required task.

Figure 13A:
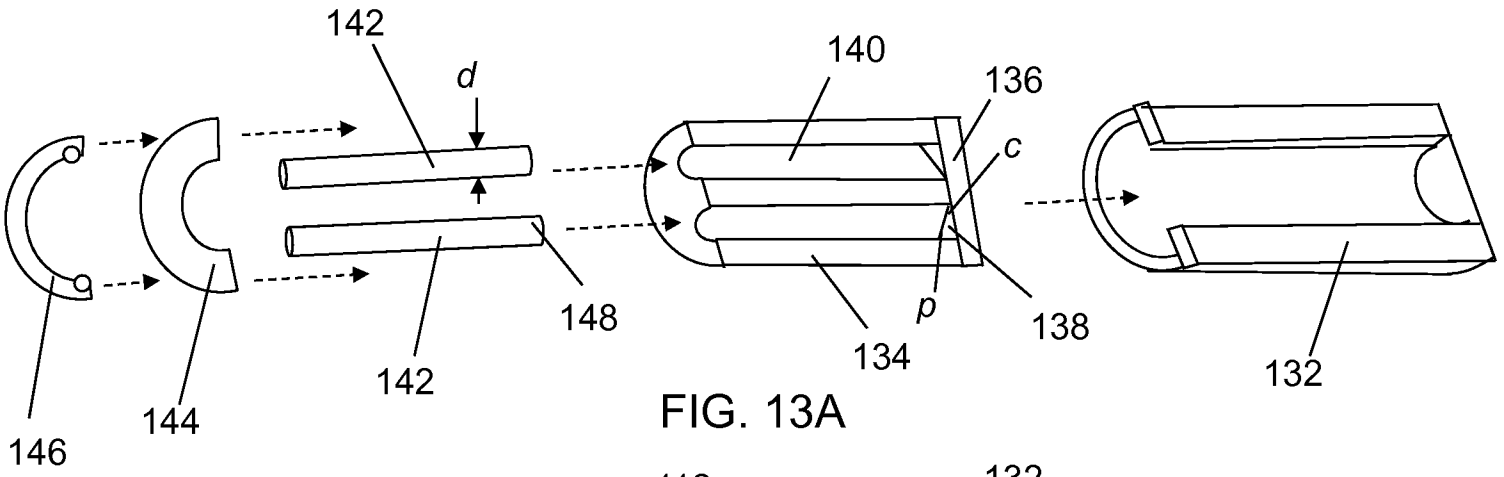
FIG. 13A is an exploded view of an embodiment of a releasable tool attachment as a stud removal tool for an embodiment of the multi-function tool of the present invention.
Figure 13B:
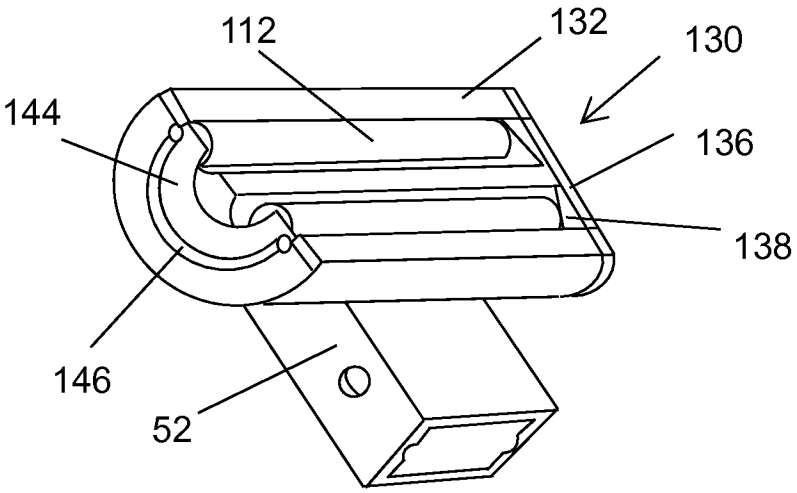
FIG. 13B is a perspective view of an embodiment of the stud removal tool releasable tool attachment for an embodiment of the multi-function tool of the present invention.

In a further embodiment of a tool attachment, a first piece of a mated pair of a stud removal tool 130 is shown in FIGS. 13A and 13B. The re-buildable tool 130 has an outer shell 132 that houses an aluminum or other metallic insert 134. The insert 134 has a base 136 with a ramped or tapered platform 138 within a set of roller guides 140. Each insert 134 may have multiple guides 140 to accommodate studs of differing diameters and dimensions. The roller guides 140 are of a wider dimension than the diameter d of a roller 142 and of a matching width to the tapered platform 138. A washer 144 holds the rollers 142 within the guides 140 and a snap ring 146 secures the insert 134 with rollers 112 within the outer shell 132. The tapered platform 138 permits rotation of the rollers in one direction where the base of the roller 148 freely rotates within the lower portion c of the taper 138 where the entire length of the roller 142 is separated from the washer 144 at the top of the insert 134.

In attaching and mating a pair of stud removal tool attachments 130 by rotating the multi-function tool 10 provides for rotation of the rollers 142 as the base of the roller 148 is seated in the lower portion c of the taper 138. In rotating the multi-function tool 10 in an opposite direction the base 148 of the roller 142 rides up the taper 138 to the top portion p of the taper 138 and is wedged with the washer 144 and prevented from rolling. Using the grip 13 of the handle and the adjustment and locking mechanism of the multi-function tool 10, a stud or other workpiece can be securely held and be twisted or broken for removal as required.

The invention has been described in detail with particular reference to certain preferred embodiments thereof, but it will be understood that variations and modifications can be effected within the spirit and scope of the invention.

What is claimed is:

1. An automatically locking hand tool comprising:

a first handle pivotally connected to an articulating arm, the first handle having a tool attachment;

a second handle pivotally connected to the articulating arm, the second handle having a tool attachment;

a brace extending between the first and second handle, the brace supporting a crescent gear;

a spring attached to the crescent gear pulling the crescent gear towards a locking pin; and wherein the locking pin engages the crescent gear and sets a specific distance between the first and second handle.

2. The automatically locking hand tool of claim 1 wherein the tool attachments are replaceable using a quick release tool attachment fixture.

3. The automatically locking hand tool of claim 2 wherein the quick release tool attachment fixture is repairable.

4. The automatically locking hand tool of claim 2 wherein tool attachments having different functions are installed to the first and second handles.

5. The automatically locking hand tool of claim 1 further comprising a trigger to release the locking mechanism.

6. The automatically locking hand tool of claim 1 further comprising a butterfly nut to set a range of distance between the first and second handle.

7. A method of manufacture of an automatically locking hand tool comprising the steps of:

pivotally connecting a first handle to an articulating arm, the first handle having a tool attachment;

pivotally connecting a second handle to the articulating arm, the second handle having a tool attachment;

extending a brace between the first and second handle;

supporting a crescent gear with the brace;

attaching a spring to the crescent gear to pull the crescent gear towards a locking pin; and engaging the locking pin to the crescent gear to set a specific distance between the first and second handle.

8. The method of manufacture of an automatically locking hand tool of claim 7 comprising replacing tool attachments using a quick release attachment fixture.

9. The method of manufacture of an automatically locking hand tool of claim 7 comprising repairing the quick release attachment fixture.

10. The method of manufacture of an automatically locking hand tool of claim 7 comprising actuating a trigger to release the locking mechanism.

11. The method of manufacture of an automatically locking hand tool of claim 7 comprising setting a range of distance between the first and second handle using a butterfly nut.

* * * * *